US007602931B2

(12) United States Patent
Akino et al.

(10) Patent No.: US 7,602,931 B2
(45) Date of Patent: Oct. 13, 2009

(54) GASKET FOR REDUCING ELECTROMAGNETIC INTERFERENCE IN A BOUNDARY MICROPHONE

(75) Inventors: Hiroshi Akino, Machida (JP); Kazuhisa Kondo, Machida (JP); Satoshi Yoshino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 815 days.

(21) Appl. No.: 11/129,288

(22) Filed: May 16, 2005

(65) Prior Publication Data

US 2005/0259842 A1 Nov. 24, 2005

(30) Foreign Application Priority Data

May 18, 2004 (JP) ..... 2004-147310

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/355; 381/361

(58) Field of Classification Search ..... 381/322, 381/355

See application file for complete search history.

(56) References Cited

U.S. PATENT DOCUMENTS

| | | | | |
|---|---|---|---|---|
| 5,640,457 | A * | 6/1997 | Gnecco et al. | 381/322 |
| 6,291,369 | B1 * | 9/2001 | Yoshikawa et al. | 442/58 |
| 2002/0108767 | A1 * | 8/2002 | Kim | 174/35 R |

* cited by examiner

*Primary Examiner*—Brian Ensey
*Assistant Examiner*—Matthew Eason
(74) *Attorney, Agent, or Firm*—Manabu Kanesaka

(57) ABSTRACT

A boundary microphone including a microphone case is provided whereby sufficient shielding performance can be achieved against strong electromagnetic waves of cellular phones. In the boundary microphone, a microphone case 1 includes a flat metallic base 10 opened on its top surface and a metallic microphone cover 20 mounted on the base 10 so as to cover the top surface of the base 10, the microphone cover 20 having a number of openings (sound wave introduction holes) thereon, the microphone case 1 housing a microphone unit 31, wherein a gasket 40 having elasticity and conductivity is disposed between the base 10 and an edge face 20*a* of the microphone cover 20.

1 Claim, 2 Drawing Sheets

GASKET FOR REDUCING ELECTROMAGNETIC INTERFERENCE IN A BOUNDARY MICROPHONE

RELATED APPLICATIONS

The present application is based on, and claims priority from, Japanese Application Number 2004-147310, filed May 18, 2004, the disclosure of which is hereby incorporated by reference herein in its entirety.

TECHNICAL FIELD

The present invention relates to a boundary microphone and more specifically relates to a gasket for reducing electromagnetic interference in a boundary microphone for preventing noise caused by external electromagnetic waves.

BACKGROUND ART

A boundary microphone (surface-mount sound pickup microphone) is also called a surface mount microphone because it is placed on a desk or floor for the use in, e.g., a TV studio and a conference. As described in Patent Document 1 (Japanese Utility Model Registration No. 2515812), a flat microphone case is used for a boundary microphone. An example will be discussed below with reference to the sectional view of FIG. 4 and the exploded sectional view of FIG. 5.

According to this example, a microphone case 1 used for a boundary microphone is basically constituted of two components of a metallic flat base 10 which is opened on its top surface and a metallic microphone cover 20 which has a number of openings (sound wave introduction holes) and is mounted on the base 10 so as to cover the top surface of the base 10.

In ordinary cases, the base 10 is formed by casting such as zinc die casting. A punching plate (perforated plate) is used as the microphone cover 20. A wire mesh body may be used instead of the punching plate. The microphone cover 20 is secured to the base 10 at one point by a screw. The microphone cover 20 is not secured at multiple points in consideration of its appearance.

To be specific, a screw insertion hole 21 is bored almost at the center of the microphone cover 20, a boss 11 having a female screw is raised on the insertion hole 21, so that the microphone cover 20 is fixed on the base 10.

The base 10 and the microphone cover 20 form a shield space in the microphone case 1. A circuit board 30 having a condenser microphone unit 31 mounted thereon is housed in the shield space. Moreover, an impedance converter, a tone control circuit, an output circuit, and the like (not shown) are mounted on the circuit board 30. A microphone code 32 is connected to the circuit board 30 and drawn from the base 10 through a code bushing 33.

Incidentally, the punching plate used as the microphone cover 20 is composed of, e.g., an iron plate on which a number of holes are made. The punching plate is cut into a predetermined shape and then pressed into a desired shape. Since the punching plate is a perforated plate, an edge face (cut face) 20*a* making contact with the base 10 becomes uneven. The casting surface of the base 10 also becomes uneven in the case of die casting. Thus, an electrical connection between the base 10 and the microphone cover 20 is point contact at multiple points.

Considering the influence of electromagnetic waves, the interference of electromagnetic waves in ordinary VHF and UHF band used in broadcast stations can be sufficiently handled by the shield of the base 10 and the microphone cover 20. However, in the field of microphones, the influence of strong electromagnetic waves of cellular phones has become a focus of attention as cellular phones have rapidly become widespread in recent years.

To be specific, when cellular phones are used, extremely strong electromagnetic waves are generated. (for example, in a range of about several cm to several tens cm, an electric field is several tens of thousands times as strong as an electric field generated by commercial radio waves).

In the shield of the base 10 and the microphone cover 20, an electrical contact is a point contact, so that the microphone cover 20 may act as an antenna and cause noise in the presence of the strong electromagnetic waves.

SUMMARY OF THE INVENTION

Therefore, it is an object of the present invention to provide a boundary microphone comprising a microphone case which can sufficiently act as a shield against strong electromagnetic waves of cellular phones.

In order to attain the object, the present invention is a boundary microphone comprising a microphone case including a flat metallic base opened on its top surface and a metallic microphone cover mounted on the base so as to cover the top surface of the base, the microphone cover having a number of openings thereon, the microphone case housing a microphone unit, wherein a gasket having elasticity and conductivity is disposed between the base and the edge face of the microphone cover.

In the present invention, it is preferable that the gasket have an elastic core and conductive fiber for covering the entire periphery of the core and the gasket be disposed over the edge face of the microphone cover.

According to the present invention, the gasket having elasticity and conductivity is interposed between the base and the uneven edge face of the microphone cover, thereby achieving sufficient shielding performance against strong electromagnetic waves of high frequency. Also, the gasket can absorb a wobble caused by a dimension error of the base and/or the microphone cover. Moreover, even when the microphone cover is repeatedly attached or detached to change the microphone unit, the initial shielding performance can be maintained.

DETAILED DESCRIPTION

Figure 1:
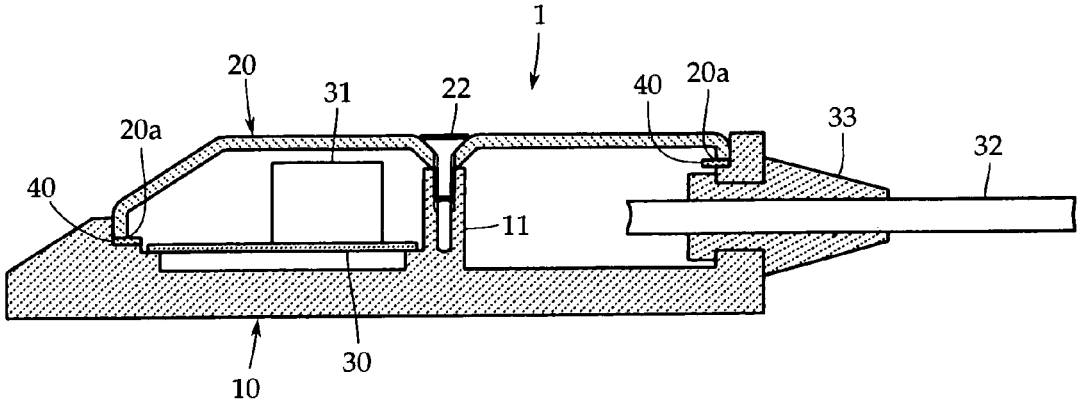
FIG. 1 is a sectional view showing a boundary microphone of the present invention.
Figure 2:
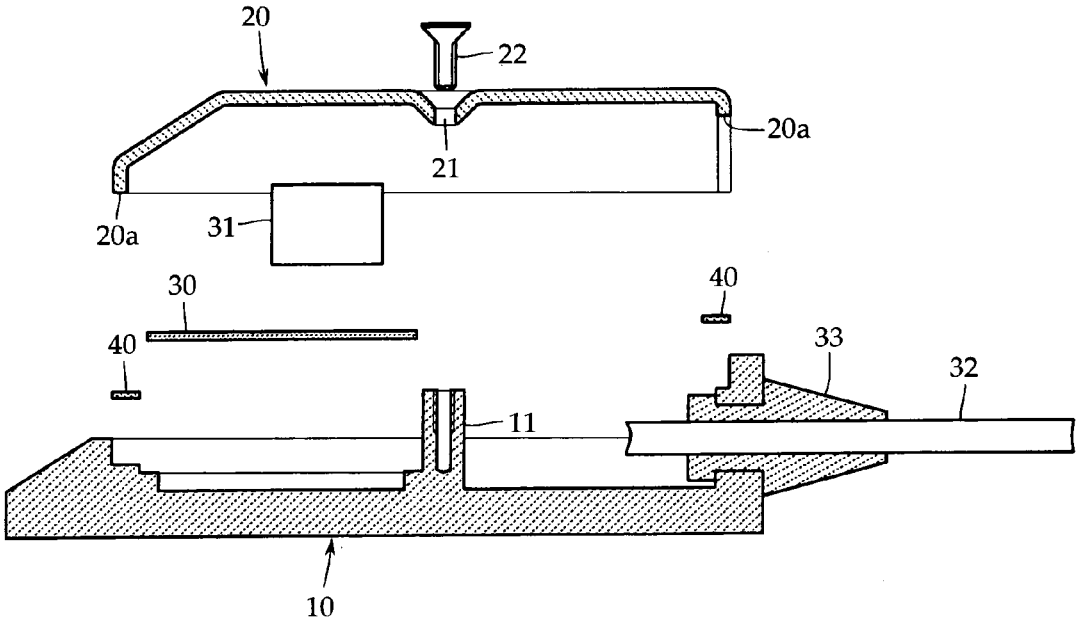
FIG. 2 is an exploded view of FIG. 1.
Figure 3:
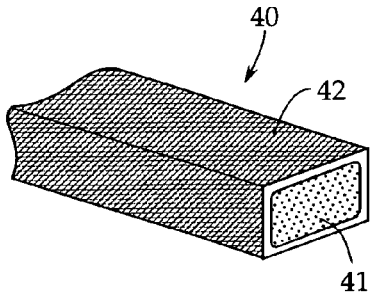
FIG. 3 is an enlarge perspective view showing a part of a gasket used for the present invention.
Figure 4:
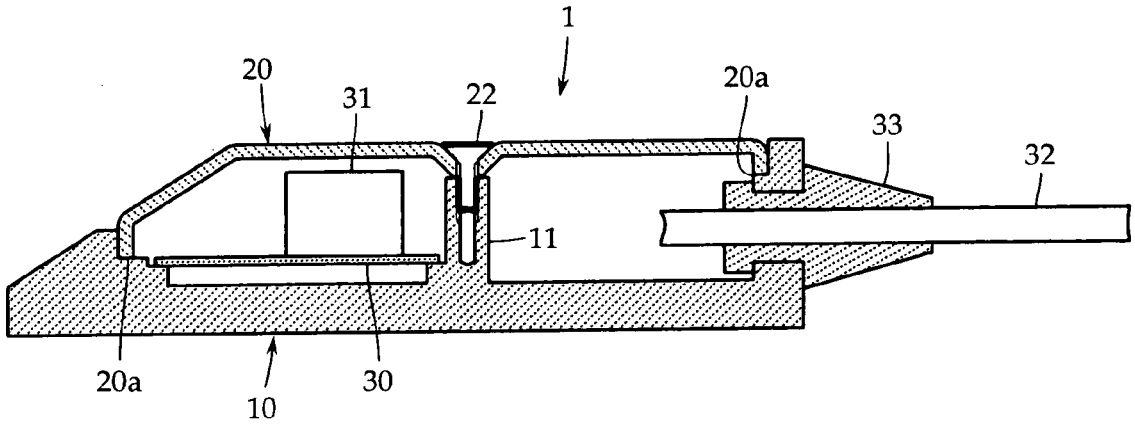
PRIOR ART FIG. 4
FIG. 4 is a sectional view showing a conventional boundary microphone.
Figure 5:
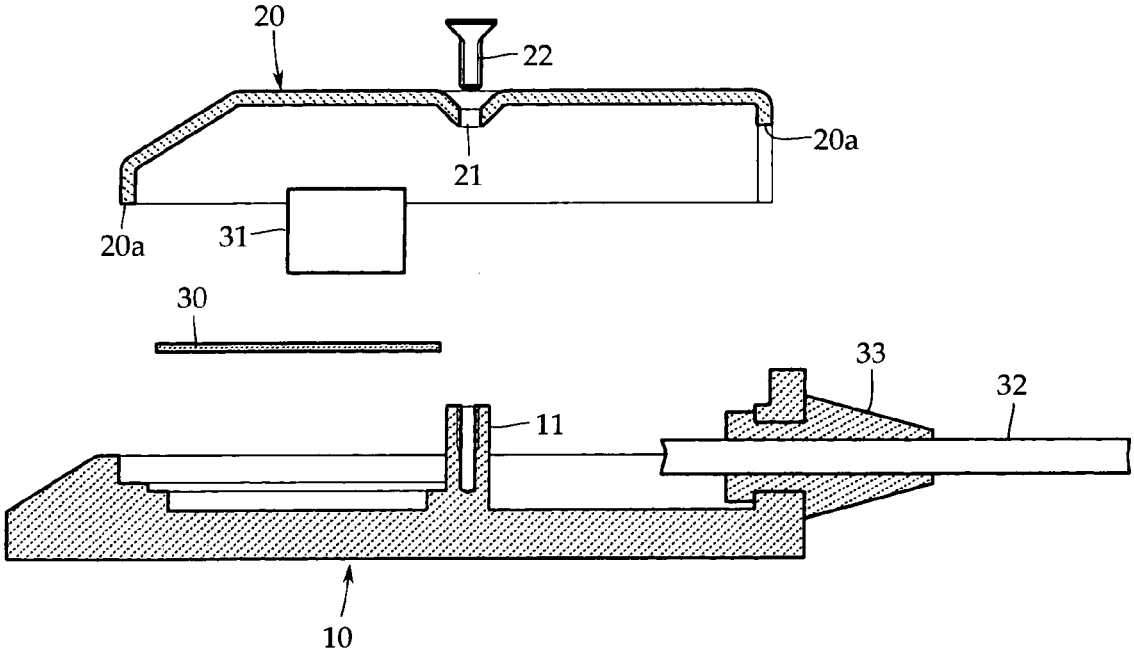
PRIOR ART FIG. 5
FIG. 5 is an exploded view of FIG. 4.

Referring to FIGS. 1 to 3, an embodiment of the present invention will be described below. The present invention is not limited to this embodiment. FIG. 1 is a sectional view showing a boundary microphone of the present invention. FIG. 2 is an exploded sectional view. FIGS. 1 and 2 correspond to FIGS. 4 and 5, respectively. FIG. 3 is an enlarge perspective view showing a part of a gasket used for the present invention. In the explanation of this embodiment, constituent elements which can be analogous to those of the foregoing conventional example shown in FIGS. 4 and 5 will be indicated by the same reference numerals.

As shown in FIGS. 1 and 2, also in the boundary microphone of the present invention, a microphone case 1 may be constituted of two components of a metallic flat base 10 which is opened on its top surface and a metallic microphone cover 20 which has a number of openings (sound wave introduction holes) and is mounted on the base 10 so as to cover the top surface of the base 10.

In ordinary cases, the base 10 is formed by casting such as zinc die casting. Besides, a press-molded article made of a metal may be used. A punching plate (perforated plate) made of iron and so on is used as the microphone cover 20. A wire mesh body may be used instead of the punching plate. Painting may be performed thereon.

Also in this case, the microphone cover 20 is secured to the base 10 by a screw. It is preferable that the microphone cover 20 be secured like the conventional example at one point by means of a fixing screw 22 and a boss 11 in consideration of its appearance (design). However, the way to secure is not a main part of the present invention and thus the microphone cover 20 may be secured by screws at multiple points. In some cases, the microphone cover 20 may be fixed to the base 10 by a method other than screwing.

A circuit board 30 and a condenser microphone unit 31 are housed in a shield space formed by the base 10 and the microphone cover 20. The condenser microphone unit 31 may be housed in the microphone case 1 while being mounted on the circuit board 30, or the condenser microphone unit 31 may be housed separately from the circuit board 30.

An impedance converter, a tone control circuit, an output circuit, and the like (not shown) may be mounted on the circuit board 30. Further, a microphone code 32 is connected to the circuit board 30 and is drawn from the base 10 through a code bushing 33.

The microphone cover 20 is cut from a punching plate (wire mesh body) into a predetermined shape and then pressed into a desired shape. Thus, an edge face (cut face) 20*a* making contact with the base 10 becomes uneven. The casting surface of the base 10 is not flat in the case of die casting.

Therefore, an electrical connection between the base 10 and the microphone cover 20 is point contact at multiple points. Even if the base 10 has an even casting surface, the electrical connection between the base 10 and the microphone cover 20 is point contact at multiple points as long as the edge face 20*a* of the microphone cover 20 is uneven.

In such a point contact, for example, when a cellular phone is used near the microphone and strong electromagnetic waves are applied to the microphone case 1, the microphone cover 20 may act as an antenna receiving the electromagnetic waves, the electromagnetic waves may be detected by the impedance converter, and noise may occur.

In order to prevent noise, in the present invention, a gasket 40 having elasticity and conductivity is disposed between the base 10 and the edge face 20*a* of the microphone cover 20. Although it is preferable to dispose the gasket 40 over the edge face 20*a* of the microphone cover 20, the gasket 40 may be partially disposed at several points.

FIG. 3 shows an example of the gasket 40. The gasket 40 has an elastic core 41 covered with conductive fiber (conductive fabric) 42. The core 41 is shaped like a column or a cylinder made of an elastic material such as a sponge and a rubber.

The conductive fiber 42 is preferably obtained by performing nickel plating on nylon fiber having been coated with silver. Such a gasket 40 having elasticity and conductivity is, for example, Soft Shield 5000 (trade name), TAIYO WIRE CLOTH CO., LTD. The conductive fiber 42 may be fabric woven of thin coil conductors.

By interposing the gasket 40 between the base 10 and the edge face 20*a* the microphone cover 20, the microphone cover 20 and the base 10 are electrically connected to each other with a low impedance. Thus, an effective shield space against strong electromagnetic waves of high frequency is provided in the microphone case 1.

Further, the gasket 40 can absorb a wobble caused by a dimension error of the base 10 or the microphone cover 20. Even when the microphone cover 20 is repeatedly attached or detached to change the condenser microphone unit 31, the initial shielding performance can be maintained.

The invention claimed is:

1. A boundary microphone, comprising:

a microphone case including a flat metallic base opened on a top surface and a metallic microphone cover mounted on the base so as to cover the top surface of the base, the microphone cover having a number of sound wave introduction holes therein, a microphone unit housed in the microphone case, and a gasket having elasticity and conductivity and disposed between the base and an edge face of the microphone cover, said gasket comprising an elastic core and a conductive fabric covering the elastic core, said conductive fabric being a fabric woven of thin coil conductors so that the microphone cover and the base are electrically connected to each other with a low impedance to effectively shield space against strong electromagnetic waves of high frequency.

* * * * *